US011785690B2

(12) United States Patent
Secretin et al.

(10) Patent No.: US 11,785,690 B2
(45) Date of Patent: Oct. 10, 2023

(54) LIGHT SYSTEM WITH CONTROLLABLE BRANCHES OF LIGHT ELEMENTS

(71) Applicant: Schreder S.A., Brussels (BE)

(72) Inventors: Laurent Secretin, Remicourt (BE); Michel Delvaux, Henri-Chapell (BE)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 17/427,795

(22) PCT Filed: Feb. 12, 2020

(86) PCT No.: PCT/EP2020/053652
§ 371 (c)(1),
(2) Date: Aug. 2, 2021

(87) PCT Pub. No.: WO2020/165284
PCT Pub. Date: Aug. 20, 2020

(65) Prior Publication Data

US 2022/0151042 A1 May 12, 2022

(30) Foreign Application Priority Data

Feb. 12, 2019 (NL) ..... 2022561

(51) Int. Cl.
*H05B 45/46* (2020.01)
*H05B 45/20* (2020.01)

(52) U.S. Cl.
CPC ..... *H05B 45/46* (2020.01); *H05B 45/20* (2020.01)

(58) Field of Classification Search
None
See application file for complete search history.

(56) References Cited

U.S. PATENT DOCUMENTS

2009/0226154 A1* 9/2009 Thomas ..... H02M 7/00 388/828
2015/0009677 A1 1/2015 Catalano
(Continued)

FOREIGN PATENT DOCUMENTS

WO 2015074881 A1 5/2015
WO WO20150704881 * 5/2015 ..... H05B 45/46

OTHER PUBLICATIONS

PCT International Search Report and Written Opinion, Application No. PCT/EP2020/053652, dated Jun. 25, 2020, 19 pages.

*Primary Examiner* — Crystal L Hammond
(74) *Attorney, Agent, or Firm* — McDonnell Boehnen Hulbert & Berghoff LLP

(57) ABSTRACT

Example embodiments relate to light systems with controllable branches of light elements. One example light system includes at least two parallel branches, each branch including a series connection of a plurality of light elements and a switching element. The at least two parallel branches are intended to share a common regulated current source configured for feeding the at least two parallel branches. The light system also includes a control module having a supply input line and at least two control output lights. The at least two control output lines are connected for controlling the switching elements of the at least two parallel branches. The control module optionally includes a galvanic isolation. The control module is configured for controlling the switching elements of the at least two parallel branches according to at least two different control schemes: a first control scheme and a second control scheme.

21 Claims, 7 Drawing Sheets

(56) References Cited

U.S. PATENT DOCUMENTS

| | | | | |
|---|---|---|---|---|
| 2015/0229149 | A1* | 8/2015 | Fahlenkamp | H02M 3/33523 320/114 |
| 2018/0110102 | A1* | 4/2018 | Adams | H05B 45/20 |
| 2018/0159434 | A1* | 6/2018 | Werner | H02M 1/08 |

* cited by examiner

| | |
|---|---|
| B1 | on |
| B2 & Ba | off |

| | |
|---|---|
| B1 | on |
| B2 | on |
| Ba | off |

| | |
|---|---|
| B1 | off |
| B2 | off |
| Ba | on |

LIGHT SYSTEM WITH CONTROLLABLE BRANCHES OF LIGHT ELEMENTS

FIELD OF INVENTION

Cross-Reference to Related Applications

The present application is a national stage entry of PCT/EP2020/053652 filed Feb. 12, 2020, which claims priority to NL 2022561 filed Feb. 12, 2019, the contents of each of which are hereby incorporated by reference.

The field of invention relates to light systems, in particular luminaires, and more in particular outdoor luminaires such as outdoor luminaires for streetlights.

BACKGROUND

Existing luminaires typically comprise a plurality of light elements, one or more drivers functioning as one or more current sources for driving the plurality of light elements, and a control module for controlling the driving.

By using control modules built into the light systems, modern lighting systems offer a plurality of operating and control possibilities for adjusting or optimizing lighting conditions. For example, brightness, light color and spectrum, light temperature, etc. can be set depending on the situation. For example, it is known to control the driving of a plurality of red, green and blue LEDs to generate white light.

Some existing systems use separate drivers for driving different groups of LEDs of the light system. Such systems have the disadvantage of an increased space and cost for the drivers.

Other existing systems, sometimes called multi-channel or multi-branch systems, use a single driver in combination with switching elements which are controlled by a control module to switch on/off certain light elements independently of other light elements. Often pulse width modulation techniques are used to control the switching elements in order to switch on/off a channel or branch with one or more lighting elements. In such systems, the power that needs to be provided by the single driver is the sum of the power that is needed in each of the branches or channels. In other words, the driver has to be able to cope with power changes. Problems encountered with such systems are amongst others flickering during switching, a current in the branches which is too high after switching. Also, these problems may be different depending on the type of driver that is being used.

SUMMARY

The object of embodiments of the invention is to provide a lighting system with multiple branches or channels, which can be driven by a single driver, and which operates well with different types of drivers.

According to a first aspect, there is provided a light system comprising at least two parallel branches and a control module. Each branch comprises a series connection of at least one light element and a switching element. The at least two parallel branches are intended to share a common regulated current source, i.e. a common driver, for feeding the at least two parallel branches. The control module has a supply input line and at least two control output lines. The at least two control output lines are connected for controlling the switching elements of the at least two parallel branches. The control module comprises a galvanic isolation between the supply input line and the at least two control output lines.

The control module is configured to generate at least two control signals on said at least two control output lines such that during a first time interval only a first switching element of said at least two switching elements is on and the other one or more switching elements of said at least two switching elements is/are off, during a subsequent overlap interval said first switching element and one other switching element of said at least two switching elements are on, and during a subsequent second time interval said first switching element is off and only said one other switching element of said at least two switching elements is on.

In other words, in such lighting systems, when switching between branches, there is a brief overlap period during which both branches will be "activated". In that manner, visible flickering problems may be reduced or avoided. Further, the overlap period may be chosen to be sufficiently small, so that too high current peaks in the branches are avoided. More in particular, the overlap interval may be chosen such that the total current provided by the common regulated current source, i.e. the common driver, before, during and after switching remains within acceptable boundaries. This will increase the life time of the driver. The overlap interval may be fixed or may be set in function of the type of driver. The inventors have found that it may be possible to set a fixed overlap interval which works well for a plurality of different types of drivers. However, it is also possible to set an optimized overlap interval for a particular driver.

By providing a galvanic isolation in the control module between the supply input line and the at least two control output lines, the control module may use any supply voltage, e.g. a supply voltage which is coming from the driver. Indeed, some types of drivers provide as an output an auxiliary supply voltage (Vaux) which may be used as a voltage supply for the control module. By making it possible to use the auxiliary voltage supply of the driver, it is avoided that a separate protected voltage supply for the control module is required, resulting in a more compact, robust and cost-efficient solution.

The light system is preferably for use in an outdoor luminaire By outdoor luminaires, it is meant luminaires which are installed on roads, tunnels, industrial plants, campuses, parks, cycle paths, pedestrian paths or in pedestrian zones, stadiums, airports, harbors, rail stations, for example, and which can be used notably for the lighting of an outdoor area, such as roads and residential areas in the public domain, private parking areas and access roads to private building infrastructures, etc.

In exemplary embodiments, the overlap interval is between 1 and 500 ns, preferably between 5 and 100 ns. Such overlap intervals provide a well controlled switching between the branches.

In exemplary embodiments, the at least two control signals may be periodic signals. The at least two periodic signals may have the same period, or may have a different period. For example, each control signal of said at least two control signals may have a period between 1 microsecond and 1 millisecond, preferably between 1 and 500 microseconds. A first control signal may have a first duty cycle and a second control signal may have a second duty cycle. The first and second duty cycles may be the same or different. For example, when two branches are present, a first control signal could have a duty cycle of 70,1% and a second control signal could have a duty cycle of 30,1% resulting in a total overlap period corresponding with a period of $2\times0.1\%=0.2\%$ of the period of the periodic signals. More generally, the sum of the duty cycles of the at least two control signals may be 100% plus the percentage of the one or more overlap periods.

In an exemplary embodiment, the control module is configured to adjust the duration of the overlap interval. In that manner the overlap interval may be adjusted e.g. to the type of driver, the type of light elements, etc. More in particular, the overlap interval may be set to reduce flicker and avoid significant current variations during switching.

In an exemplary embodiment, the galvanic isolation comprises any one of the following: an opto-coupler, an RF coupling, a transformer. The RF coupling could be a capacitive coupling or an inductive coupling.

In an exemplary embodiment, the control module is configured for controlling the switching elements of the at least two parallel branches according to at least two different control schemes comprising:

- a first control scheme wherein the at least two control signals are such that the at least one light element of a first branch of said at least two branches is on during a first percentage of an operational time during which the light system operates according to the first control scheme; wherein the first percentage may be any value from 0% to 100%;
- a second control scheme wherein the at least two control signals are such that the at least one light element of the first branch of said at least two branches is on during a second percentage of an operational time during which the light system operates according to the second control scheme; wherein the first percentage is different from the second percentage.

In such an embodiment, if the first and the second branch contain different types of light elements, the light observed when the first control scheme is used will be different from the light observed when the second control scheme is used. For example, the first branch may contain one or more light elements of a first color and the second branch may contain one or more light elements of a second color different from the first color. In another example, the first branch may contain one or more light elements emitting warm white light and the second branch may contain one or more light elements emitting cool white light. Also, when the first and second branches contain the same type and number of light elements, but on different positions, a different light pattern may be obtained depending on the control scheme used. In yet another example, the first branch may be associated with a first group of one or more first optical elements and the second branch may be associated with a second group of one or more second optical elements, said second group being different from the first group.

In an exemplary embodiment, the at least two branches comprise at least a first and a second branch, and the control module is configured for controlling the switching elements of the at least two parallel branches according to at least two different control schemes comprising:

- a first control scheme for which the first branch is never activated;
- a second control scheme for which the first and second branch are activated using the at least two control signals such that during the first time interval only the first switching element of the first branch is on and the other one or more switching elements of the at least two branches are off, during the subsequent overlap interval the first and second switching element of the first and second branch are on, and during the subsequent second time interval said first switching element is off and only said second switching element is on.

In such an embodiment, the pattern of the light projected on a surface to be illuminated may be changed. Indeed, the illuminated surface area may be different according to the first or second control scheme. For example, the first branch may contain a first plurality of light elements arranged in a row, and the second branch may contain a second plurality of light elements arranged in a second row e.g. parallel to the first row. The first plurality and the second plurality are preferably the same, so that the voltage over the plurality of LEDs of a first and second branch is substantially the same. According to the second control scheme the light pattern will be observed as a pattern caused by the two rows of light elements, whilst according to the first control scheme only the second row is generating light and the observed pattern will be different. In other words the photometry of the lighting system may be changed by choosing a particular control scheme.

The skilled person understands that the light elements of a branch do not need to be arranged in a single row, but could be arranged in any suitable manner. For example the light elements of a branch may be arranged in an array of p×q elements on a PCB, wherein p>1 and/or q>1. Also, the light elements of all branches may be arranged in any suitable manner in an array on a PCB, e.g. grouped per branch or mixed. In a possible embodiment, light elements of the same branch may be located in adjacent positions within the array. However, light elements of the same branch may also be in non-adjacent positions within the array, with one or more light elements of other branches inserted between two light elements of the same branch.

By choosing an appropriate position for the lighting elements in the array on the PCB different light outputs can be achieved with different control schemes as described above. A light output may refer to a light pattern on the ground, a color, a color temperature, an intensity, a different flashing pattern, etc.

According to a second aspect there is provided a light system comprising at least two parallel branches and a control module. Each branch comprises a series connection of a plurality of light elements and a switching element. The at least two parallel branches are intended to share a common regulated current source, e.g. a commercially available LED driver, configured for providing a current to the at least two parallel branches. The control module has a supply input line and at least two control output lines. The at least two control output lines are connected for controlling the switching elements of the at least two parallel branches. Optionally, the control module may comprise a galvanic isolation between the supply input line and the at least two control output lines, as has been described above. The control module is configured for controlling the switching elements of the at least two parallel branches according to at least two different control schemes comprising:

- a first control scheme which is such that the plurality of light elements of a first branch of said at least two branches is on during a first percentage of an operational time during which the light system operates according to the first control scheme; wherein the first percentage may be any value from 0% to 100%;
- a second control scheme which is such that the plurality of light elements of the first branch of said at least two branches is on during a second percentage of an operational time during which the light system operates according to the second control scheme; wherein the first percentage is different from the second percentage.

When, in the first or second control scheme the percentage is not 0% or 100%, preferably the at least two branches are alternatively activated, optionally with some overlap as defined above.

Preferably, the first control scheme is such that the first branch of said at least two branches is never activated, i.e. the first percentage is 0%, whilst at least one other branch of the at least two branches is activated for at least a portion of an operational time during which the light system operates according to the first control scheme; and the second control scheme is such that the at least two branches are alternatively activated, i.e. the second percentage is larger than 0% and smaller than 100%, optionally with a limited amount of overlap. In such an embodiment, the pattern of the light projected on a surface to be illuminated may be changed. Indeed, the illuminated surface area may be different according to the first or second control scheme. According to the second control scheme the light pattern will be observed as a pattern caused by the light elements of the first and second branch, whilst according to the first control scheme only the second branch is generating light and the observed pattern will be different. In other words, the photometry of the lighting system, and in particular a conical envelope of the light distribution as defined below, may be changed by choosing a particular control scheme.

Preferred features described below may apply to any one of the aspects mentioned above.

According to a possible embodiment, the plurality of light elements of a first branch of the at least two branches is configured to emit substantially the same color as the plurality of light elements of a second branch of the at least two branches. For example, the first and second branch may contain identical light elements. By having a first and a second different control scheme, it will be possible to change the resulting light distribution. By light distribution, it is meant the distribution generated by the light emitted by the light elements, through the one or more optical elements (see further), if present. The light distribution is delimited by a conical envelope, typically a non-circular conical shape, containing the light leaving the one or more optical elements. The light distribution represents the emission directions and the intensity variations of the light within the envelope. Thus, the light pattern on the ground may be different according to the first or second control scheme.

According to a possible embodiment, the light elements of the at least two branches are arranged in an array comprising at least two rows, and wherein a row of said at least two rows comprises light elements of two different branches of said at least two parallel branches. For example, the light elements of a first and second branch may be arranged according to a checkerboard pattern as illustrated in FIG. 10. However, also other positioning patterns are possible for the light elements, see for example FIGS. 8 and 11. In such an arrangement, the light elements may be the same or different. The resulting light distribution according to the first and second control scheme may have a different color and/or a different light distribution. For example, according to the first control scheme the light distribution may have a first conical envelope and the light may be of a first color, and according to the second control scheme the light distribution may have a second conical envelope and a second color, wherein the first conical envelope is different from the second conical envelope and/or wherein the first color is different from the second color.

According to a further developed embodiment, at least three parallel branches are provided, and the light elements of the at least three branches are arranged in an array comprising at least two rows, and a row of said at least two rows comprises light elements of three different branches of said at least three parallel branches.

In a possible embodiment, one or more light elements of the at least two branches are associated with a distinct optical element, preferably a lens element. For example, each light element may be associated with a distinct optical element, e.g. a lens element. However, the multiple distinct optical elements may be integrated in the same optical plate, e.g. a lens plate with multiple lens elements.

According to an exemplary embodiment the one or more optical elements comprises one or more lens elements. Indeed, lens elements may be typically encountered in outdoor luminaire systems, although other types of optical elements may be additionally or alternatively present in such luminaires, such as reflectors, backlights, prisms, collimators, diffusors, and the like. According to a preferred embodiment, a lens element has a convex or planar external surface and a concave or planar internal surface facing a light element. In this manner, the light element placed at the internal surface side of the lens element has its emitted light being spread. The shape of the lens element and position of the lens element with respect to the light element will influence the distribution and intensity profile of the emitted light.

Alternatively, the one or more optical elements could be a transparent or translucent cover having a varying profile or varying optical properties (e.g. variation of thickness, transparency, diffusivity, reflectivity, refractivity, colour, etc.) along the movement direction of the second support.

The one or more optical elements may also comprise one or more light shielding structures complying with a certain glare classification, e.g. the G classification defined according to the CIE115:2010 standard and the G* classification defined according to the EN13201-2 standard. The light shielding structures may be configured for reducing a solid angle of light beams of the plurality of light elements by cutting off or reflecting light rays having a large incident angle, thereby reducing the light intensities at large angles and improving the G/G* classification of the luminaire system. The one or more light shielding structures may be an integral part of a lens plate, or may be provided as one or more separate optical elements. When they are provided as one or more separate optical elements, the one or more light shielding structures may be mounted on a lens plate.

In a possible embodiment, the light elements of the at least two branches are associated with a set containing at least two different optical elements. In other words, different optical elements may be used above different light elements or groups of light elements. The different optical elements may be used for light elements of the same branch or for light elements of a different branch.

In an exemplary embodiment, the light elements of a first branch of the at least two branches are associated with at least one first optical element and the light elements of a second branch of the at least two branches are associated with at least one second optical element which is different from the at least one first optical element. In that manner the conical envelope of the light distribution obtained with the first control scheme will be different from the conical envelope of the light distribution obtained with the second control scheme. It is noted that each light element of the first branch may be associated with an optical element of a first type and/or each light element of the second branch may be associated with an optical element of a second type different from the first type, but also other combinations are possible. For example, multiple light elements of the first branch may be put under a single optical element of the first type which is different from the one or more optical elements associated with the second branch. Also, multiple different optical elements may be associated with a single branch.

According to an exemplary embodiment, the first control scheme defines a first light distribution having a first conical envelope and the second control scheme defines a second light distribution having a second conical envelope, said second conical envelope being different from said first conical envelope.

The skilled person understands that the light elements of a branch may be arranged in any suitable manner on a PCB. For example the light elements of a branch may be arranged in an array of p×q elements, wherein p>1 and/or q>1.

Also, the light elements of all branches may be arranged in any suitable manner in an array on a PCB, e.g. grouped per branch or mixed. In a possible embodiment, light elements of the same branch may be located in adjacent positions within the array, such that groups of lighting elements which are activated together are created on the PCB. However, light elements of the same branch may also be in non-adjacent positions within the array, with one or more light elements of other branches inserted between two light elements of the same branch. This will allow obtaining a good mixing of the light between branches, e.g. a mixing of colors and/or a mixing of different whites. By choosing an appropriate position for the lighting elements in the array on the PCB a different light output can be achieved with different control schemes as described above. A different light output may refer to a different light pattern on the ground, a different color, a different color temperature, a different intensity, a different flashing pattern, etc.

Preferably each branch of the at least two branches comprises the same number of lighting elements. Preferably, each lighting element of each branch has substantially the same forward biasing voltage. When the same number of lighting elements is provided in each branch, and the lighting elements have substantially the same forward voltage, the sum of the forward voltages in each branch will also be substantially the same, such that a difference in voltage over the parallel branches when switching between branches can be avoided or reduced. However, as will be explained below the light elements and the number of light elements in each branch may also be different.

According to an exemplary embodiment, the control module is configured to receive a desired light output as an input, to select a control scheme out of a plurality of different stored control schemes in accordance with the desired light output, and to control the switching elements in accordance with the selected control scheme. In that manner a lighting system with an easily adaptable photometry is provided. A light output may refer to a light pattern on the ground, a color, a color temperature, an intensity, a flashing pattern, etc.

In a further developed embodiment, the at least two branches comprises at least a first, a second and a third branch, and the plurality of control schemes comprises at least a first control scheme for which the first branch is never activated, a second control scheme for which the second branch is never activated, and a third control scheme for which the third branch is never activated. This offers even more possibilities to change the lighting output of the lighting system.

In an exemplary embodiment, the at least two control signals consist of N control signals, wherein N>2; wherein the control module is configured to generate said N control signals using (N−1) pulse width modulated signals. This may further simplify the structure of the circuitry of the control module. In a further developed embodiment, the control module may be configured to generate three or four control signals using only two or three PWM signals, respectively.

Preferably, the control module comprises any one of the following: a field programmable gate array, an ASIC, a microcontroller. Such a component may be easily configured to generate the control signals in accordance with one or more control schemes. Optionally the control module may be provided with at least one control input line, and may be configured to control the control signals on the at least one control output line in function of the signals on the at least one control input line.

In an exemplary embodiment, the control module comprises control logic and a delay generating circuit configured for generating the at least two control signals such that the overlap interval is present. In further developed embodiments, the circuitry used to realize the galvanic isolation may also have the function of the delay generating circuit, in order to create the overlap intervals between the control signals.

In an exemplary embodiment, a first branch of the at least two branches comprises a first set of light elements and a second branch of the at least two branches comprises a second set of light elements, said second set being different from the first set. For example, the first set may comprise light elements of a first color or color temperature, and the second set may comprise light elements of a second color or color temperature. Optionally one or more dummy electronic elements, such as diodes, may be added in series with the one or more light elements of the first and/or second branch in order to compensate for a difference in forward biasing voltage between the first and the second branch. Additionally or alternatively, the number of light elements of each branch may be chosen such that the total forward voltage of a branch is the same for every branch. Noting that the individual forward voltage of a light element in different branches may be different, the number of light elements in each branch may be different.

In an exemplary embodiment, the light elements of the at least two branches are arranged in an array comprising at least two rows and at least two columns, and for each branch, the at least one light element comprises a subset of said array with at least two adjacent light elements of said array. For example the light elements may be arranged in an array of p×q elements on a PCB, wherein p>1 and/or q>1, and the light elements of the at least two branches may be grouped per branch such that the light elements of the same branch are located in adjacent positions within the array. However, in other embodiments, light elements of the same branch may also be in non-adjacent positions within the array, as explained above.

In a preferred embodiment, each light element comprises one or more light emitting diodes (LEDs). The LEDs may be any one of the following: a red LED, a green LED, a blue LED, a white LED, a warm white LED, a cool white LED, etc. Optionally the LEDs may comprise a phosphor coating. In a possible embodiment LEDs with a different phosphor but with substantially the same forward biasing voltage may be used in different branches of the at least two branches.

In a preferred embodiment, each light element may be provided with an optical element such as a lens element, a collimator, a reflector, a diffusor, etc. More preferably, the light elements may be associated with an optical plate comprising a plurality of optical elements, for example a lens plate comprising a plurality of lens elements.

In an exemplary embodiment, the lighting system further comprises a driver connected to the at least two parallel branches and configured to provide a common current for feeding the at least two parallel branches, wherein said driver is further configured to deliver a supply voltage to the supply input line of the control module. In that manner the need for an external power supply for the control module is avoided, resulting in a more compact system.

Embodiments of the first or second aspect may have more than two parallel branches, e.g. at least three parallel branches, and some technical advantages will be even more pronounced when at least three parallel branches are provided. For example, the advantages related to the overlap may be more pronounced when at least three parallel branches are provided.

According to a further aspect the invention relates to a luminaire system comprising a light system according to any one of the previous claims. Preferably, the luminaire system comprises a luminaire housing and the lighting elements are arranged on a PCB in the luminaire housing. The driver may be arranged on or in the luminaire housing, or in any other suitable location of the luminaire system, such as in a pole of the luminaire system.

BRIEF DESCRIPTION OF THE FIGURES

The accompanying drawings are used to illustrate presently preferred non-limiting exemplary embodiments of luminaires of the present invention. The above and other advantages of the features and objects of the invention will become more apparent and the invention will be better understood from the following detailed description when read in conjunction with the accompanying drawings, in which.

DESCRIPTION OF EMBODIMENTS

Figure 1:
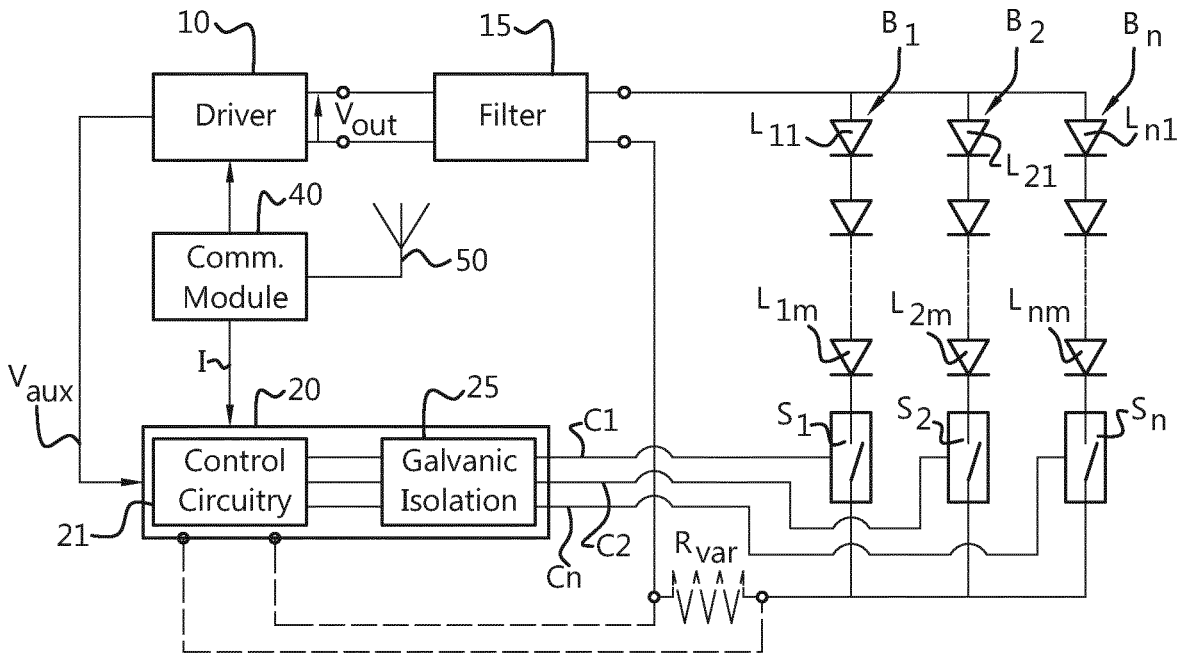
FIG. 1 is a block diagram of an exemplary embodiment of a lighting system.

FIG. 1 is a block diagram of an exemplary embodiment of a lighting system. The light system comprises a plurality of parallel branches B1, B2, . . . , Bn. Each branch B1, B2, . . . , Bn comprises a series connection of at least one light element L11 . . . L1*m*, L21 . . . L2*m*, Ln1 . . . Lnm and a switching element S1, S2, . . . , Sn. It is noted that although the number m of light elements in a branch B1, B2, . . . , Bn is shown to be the same for each branch, this is not required as will be explained below. The plurality of parallel branches B1, B2, . . . , Bn share a common regulated current source, here a driver 10 configured for feeding the plurality of parallel branches B1, B2, . . . , Bn. The driver 10 is further configured to deliver a supply voltage Vaux to the supply input line of a control module 20, see further. Optionally, the driver 10 may be provided with dimming circuitry. Optionally, a filter 15 may be provided between the driver 10 and the branches B1, B2, . . . , Bn. The filter 15 may be configured for limiting current variations during switching of the switching elements S1, S2, . . . , Sn.

Figure 2:
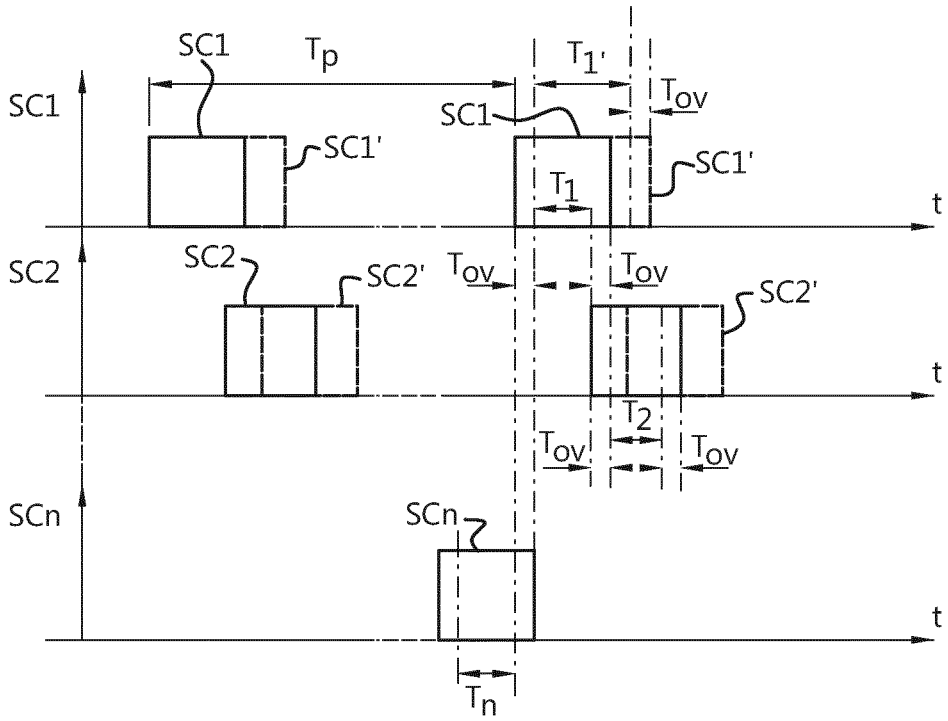
FIG. 2 is a timing diagram illustrating exemplary control signals for controlling the lighting system of FIG. 1.

The light system further comprises a control module 20 having a supply input line Vaux and a plurality of control output lines C1 . . . Cn. The plurality of control output lines C1 . . . Cn is connected for controlling the switching elements S1 . . . Sn of the plurality of parallel branches S1 . . . Sn. The control module 20 comprises control circuitry 21 and a galvanic isolation 25 between the supply input line Vaux and the plurality of control output lines C1 . . . Cn. The control module 20 is configured to generate a plurality of control signals SC1 . . . SCn on said plurality of control output lines C1 . . . Cn. As shown in FIG. 2, the control signals SC1 . . . SCn are generated such that during a first time interval T1 only a first switching element S1 of said plurality of switching elements S1 . . . Sn is on and the other one or more switching elements S2 . . . Sn are off, such that during a subsequent overlap interval Tov the first switching element S1 and one other switching element S2 are on, and such that during a subsequent second time interval T2 the first switching element S1 is off and only said one other switching element S2 is on. This is repeated for all switching elements, such that the switching elements S1 . . . Sn are on one after the other, which each time some overlap.

In the lighting system of FIG. 1, when switching between branches, there is a brief overlap period Tov during which two branches will be "activated" simultaneously. In that manner, any visible flickering problems may be reduced or avoided. Further, the overlap period Tov may be chosen to be sufficiently small, so that high current peaks in the branches are reduced or avoided. More in particular, the overlap interval Tov may be chosen such that the total current provided by the driver 10, i.e. the sum of the currents flowing in the plurality of branches B1 . . . Bn, remains within acceptable boundaries before, during and after switching. This will increase the lifetime of the driver 10. The overlap interval may be fixed or may be set in function of the type of driver 10, the type of light elements, etc.

By providing a galvanic isolation 25 in the control module 20 between the supply input line and the plurality of control output lines C1 . . . Cn, the control module 20 may use any supply voltage, e.g. a supply voltage Vaux which is coming from the driver 10, as shown in FIG. 1. Indeed, some types of drivers 10 provide as an output an auxiliary supply voltage Vaux which may be used as a voltage supply for the control module 20. By including the galvanic isolation 25, the supply input line does not need to have the same reference as the driver output voltage Vout used to drive the light elements L11 . . . L1*m*, L21 . . . L2*m*. This makes it possible to use the auxiliary voltage supply Vaux of the driver 10, such that it is avoided that a separate protected voltage supply for the control module 20 is required, resulting in a more compact, robust and cost-efficient solution. The galvanic isolation 25 may comprise any one of the following: an opto-coupler, an RF coupling, a transformer.

Although the use of a galvanic isolation 25 is preferred, also other solutions (not shown) are possible which do not use a galvanic isolation. For example, the output voltage Vout of the driver 10 could be used to power the control module 20. However, this output voltage will vary, especially during start-up making it less suitable unless certain measures are taken.

It may be possible to set a fixed overlap interval Tov which works well for a plurality of different types of drivers 10. However, it is also possible to set an optimized overlap interval Tov for a particular driver 10. To that end the control module 20 may be configured to adjust the duration of the overlap interval Tov. The overlap interval Tov may be between 1 and 500 ns, preferably between 5 and 100 ns. Such an overlap interval Tov provides a well controlled switching between the branches.

The plurality of control signals SC1 . . . SCn may be periodic signals. A control signal SC1 . . . SCn may have a period between 1 microsecond and 1 millisecond, preferably between 1 and 500 microseconds.

Optionally a variable resistor Rvar may be provided in series with the parallel branches as shown in FIG. 1. Such a variable resistor Rvar will allow an additional regulation of the current provided by the driver 10. The value of Rvar could be set during calibration, but could also be controlled during operation. For example, the value of Rvar may be increased at the beginning of a switching moment or shortly before a switching moment.

The switching elements S1 . . . Sn of the branches B1 . . . Bn may be controlled according to at least two different control schemes comprising:

- a first control scheme wherein the light elements L11 . . . L1*m* of the first branch B1 are on during a first percentage of an operational time, e.g. (T1+2*Tov)/Tp*100% as illustrated in full lines in FIG. 2;
- a second control scheme wherein the light elements L11 . . . L1*m* of the first branch B1 are on during a second percentage of an operational time, e.g. (T1'+2*Tov)/Tp*100% as illustrated in dotted lines in FIG. 2, wherein the first percentage is different from the second percentage.

For example, in a simplified case with three branches, a number of control schemes could be as follows:

TABLE 1

| | B1 | B2 | B3 | Overlap |
|---|---|---|---|---|
| Control scheme 1 | 34% | 34% | 34% | 3*Tov = 2% |
| Control scheme 2 | 30% | 40% | 32% | 3*Tov = 2% |
| Control scheme 3 | 22% | 40% | 40% | 3*Tov = 2% |

In the example provided above, the total overlap is the same for the different control schemes. However, the skilled person understands that the total overlap may also be different.

According to another example, the switching elements S1 . . . Sn of the branches B1 . . . Bn may be controlled according to at least two different control schemes comprising:

- a first control scheme for which the first branch B1 is never activated (first percentage equals 0%), whilst at least one other branch is activated for at least a portion of an operational time during which the light system operates according to the first control scheme; in Table 2 below control scheme 1, 3 and 5 fulfill this criterion;
- a second control scheme for which the first and second branch are activated using the control signals such that during the first time interval T1 only the first switching element of the first branch B1 is on and the other one or more switching elements S2 . . . Sn are off, during the subsequent overlap interval the first and second switching element S1, S2 are on, and during the subsequent second time interval T2 said first switching element S1 is off and only said second switching element S2 is on; or the second control scheme is such that the branches B1, B2, B3 are alternatively activated, optionally with a limited amount of overlap; see for example branches B1 and B2 and B3 in control scheme 2 in Table 2 below.

In an exemplary embodiment with at least a first, a second and a third branch B1, B2, B3, the plurality of control schemes may comprise at least a first control scheme for which the first branch B1 is never activated (see for example control schemes 1, 3 and 5 in Table 2 below), a second control scheme for which the second branch B2 is never activated (see for example control schemes 5, 6 and 7 in Table 2 below), and a third control scheme for which the third branch B3 is never activated (see for example control schemes 3, 4 and 6 in Table 2 below).

For example in a simplified case with three branches, a number of control schemes could be as follows:

TABLE 2

| | B1 | B2 | B3 | Overlap |
|---|---|---|---|---|
| Control scheme 1 | 0% | 51% | 51% | 2*Tov = 2% |
| Control scheme 2 | 20% | 41% | 42% | 3*Tov = 3% |
| Control scheme 3 | 0% | 100% | 0% | — |
| Control scheme 4 | 51% | 51% | 0% | 2*Tov = 2% |
| Control scheme 5 | 0% | 0% | 100% | — |
| Control scheme 6 | 100% | 0% | 0% | — |
| Control scheme 7 | 52% | 0% | 52% | 2*Tov = 4% |

The control module 20 may be configured to receive a desired light output as an input, to select a control scheme out of a plurality of different stored control schemes, e.g. the control schemes 1-7 included in Table 2 above, in accordance with the desired light output, and to control the switching elements in accordance with the selected control scheme. A light output may refer to a light pattern on the ground, a color, a color temperature, an intensity, etc. For example, if the branches contain lighting elements having different colors, by changing the percentages during which a branch is active as in Table 2 above, the color can be changed. In another example where all branches contain lighting elements of the same color, by deactivating one or more branches, the light pattern can be changed.

In the illustrated embodiment of FIG. 1, each branch B1 . . . Bn comprises the same number m of lighting elements. Such an embodiment is preferred when each lighting element of each branch has substantially the same forward biasing voltage.

In another (non-illustrated) embodiment, the first branch B1 comprises a first number m1 of light elements and the second branch B2 comprises a second number m2 of light elements, wherein m1 may be different from m2. For example, the first branch B1 may comprise light elements of a first color, and the second branch B2 may comprise light elements of a second color. Optionally, one or more dummy elements may be added in series with the one or more light elements of the first and/or second branch B1, B2 in order to compensate for a difference in forward biasing voltage between the first and the second branch B1, B2. Additionally or alternatively, the number m1, m2 of light elements of each branch B1, B2 may be chosen such that the total forward voltage of a branch is substantially the same for every branch. Noting that the individual forward voltage of a light element in different branches may be different, the number of light elements in each branch may be different. It is further noted that a branch may comprise different types of light elements. For example, a single branch may comprise light elements of different colors.

In an exemplary embodiment, the light elements of the branches B1 . . . Bn are arranged in an array on a support, typically a PCB. The array may comprise at least two rows and at least two columns. For example, if n=3 and m=4, the light elements of FIG. 1 could be arranged:

in an array of 3×4 as follows:

| | | |
|---|---|---|
| L11 | L21 | L31 |
| L12 | L22 | L32 |
| L13 | L23 | L33 |
| L14 | L24 | L34 |

or in an array of 6×2 as follows:

| | | | | | |
|---|---|---|---|---|---|
| L11 | L12 | L21 | L22 | L31 | L32 |
| L14 | L13 | L24 | L23 | L34 | L33 |

The light elements of each branch B1, B2, B3 may be adjacent light elements in the array on the support. For example, in the 3×4 array or in the 6×2 array above L11 . . . L14 form a subset of adjacent light elements.

Figure 8:
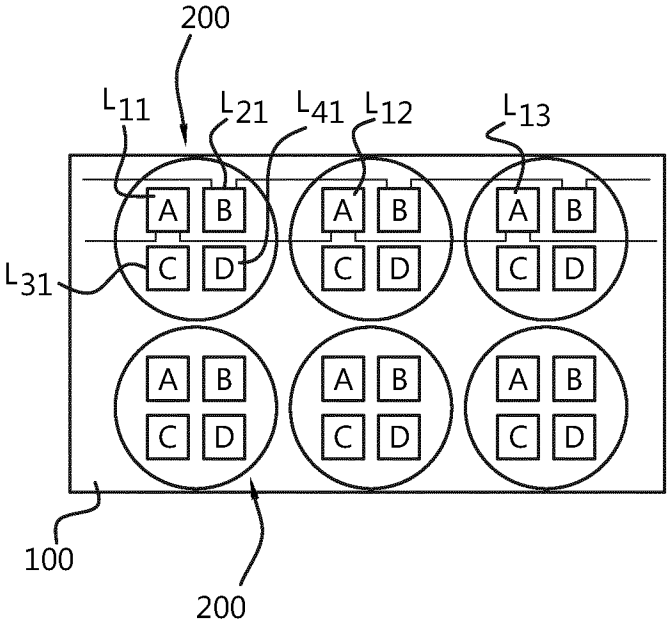
FIG. 8 illustrates schematically yet another exemplary embodiment of a part of a lighting system with four branches.

FIG. 8 illustrates another example where the light elements of the branches B1 . . . Bn are arranged in an array on a PCB 100 comprising at least two rows and at least two columns. In the illustrated example the light system comprises four branches B1, B2, B3, B4 with each six light elements and respective switching elements S1, S2, S3, S4. A plurality of optical elements 200, e.g. lens elements, is arranged above the lighting elements. The optical elements 200 may be integrated within a single plate positioned parallel to the PCB 100. The light elements L11 . . . L16 of the first branch B1 are of a first type A. The light elements L21 . . . L26 of the second branch B2 are of a second type B. The light elements L31 . . . L36 of the third branch B3 are of a third type C, and the light elements L41 . . . L46 of the fourth branch B4 are of a fourth type D. In another embodiment, all the light elements could be of the same type. The light elements may be arranged in an array of 6×4 on a PCB 100. In the example of FIG. 8, the light elements of the same branch are not adjacent to one another in the array on the PCB 100. In the illustrated example four different light elements of types A, B, C, D are grouped, and may be placed under the same optical element, e.g. a lens element 200. In the illustrated example of FIG. 8, an array of 2×2 light elements is positioned below the same optical element. However, light elements may be grouped in any manner below the same optical element, e.g. a single row of two or more light elements (which may be of the same type or of a different type) may be grouped below the same optical element, or more generally any array of p×q light elements with p and q integers and with p and/or q>1, may be grouped below the same optical element. Also, light elements may be positioned differently underneath a same optical element, e.g. positioned at the angles of a triangle, or positioned in a circle. In the example of FIG. 8, six groups are placed under six lens elements 200. The types A, B, C, D may correspond e.g. with different colors or with different kinds of white. For example A, B, C, D may correspond with red, green, blue, white. In the illustrated example the position of a light element of type A is always the same within a group, but in other embodiments the position of a light element of type A may be changed from one group to another group.

The optical elements 200 may be the same or different. For example, the optical element 200 associated with light elements L11, L12, L31, L41 may be different from the optical elements 200 associated with light elements L12, L22, L32, L42. For example optical elements 200 located more centrally on a PCB 100 may be different from optical elements 200 located near the edges of the PCB 100.

Also in the other embodiments described above, one or more light elements may be provided with an optical element such as a lens element, a collimator, a reflector, a diffusor, etc. More preferably, the light elements may be associated with a lens plate comprising a plurality of lens elements.

In a preferred embodiment, each light element comprises one or more light emitting diodes (LEDs). The LEDs may be any one of the following: a red LED, a green LED, a blue LED, a white LED, a warm white LED, a cool white LED, etc. Optionally the LEDs may comprise a phosphor coating. In a possible embodiment LEDs with a different phosphor but with substantially the same forward biasing voltage may be used in different branches of the at least two branches.

The control module 20 may comprise any one of the following: a field programmable gate array (FPGA), an ASIC, a microcontroller.

Figure 3:
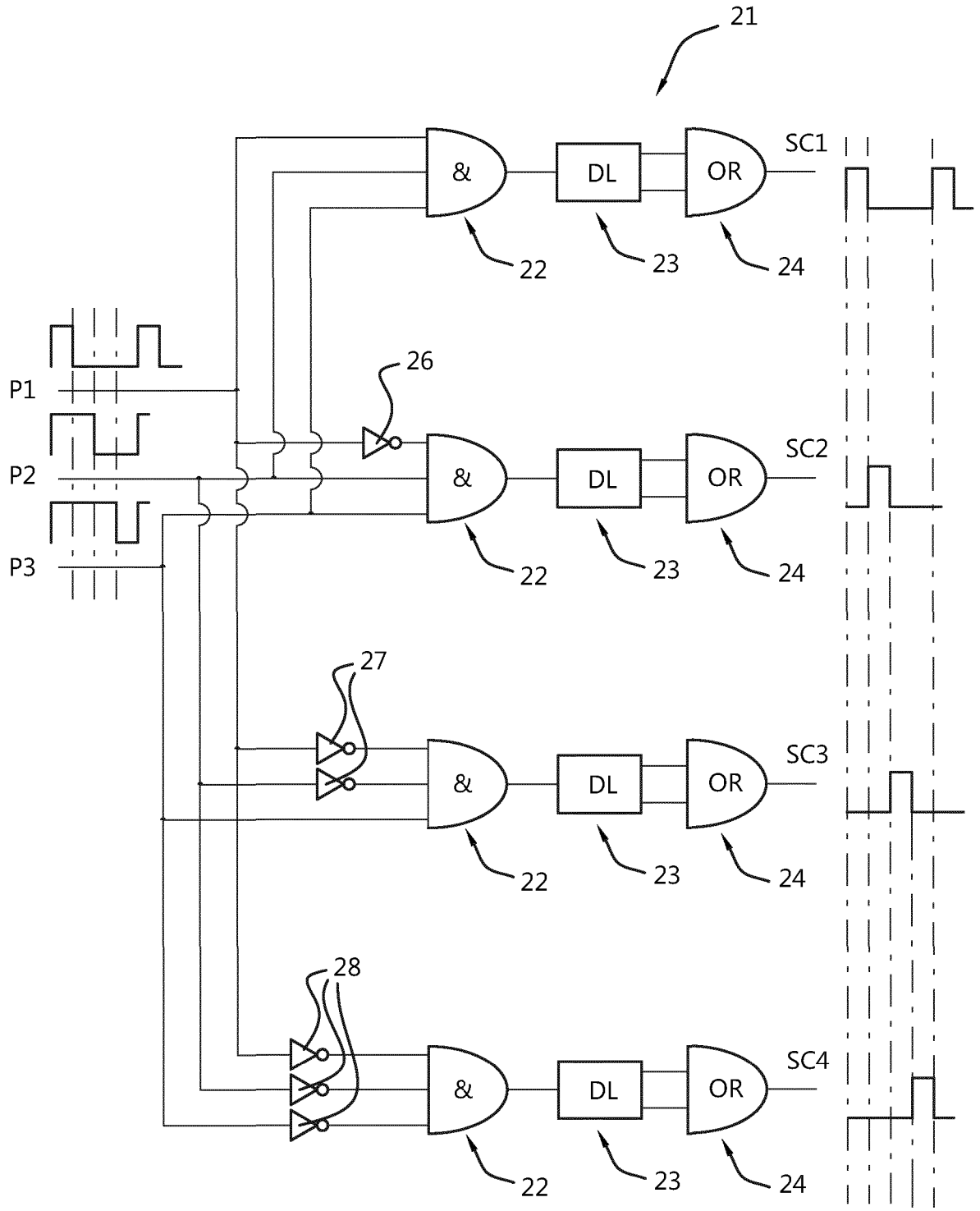
FIG. 3 is a block diagram of an exemplary embodiment of a part of a control module for generating the control signals.

FIG. 3 illustrates an example of a control circuitry 21 of a control module 20 which may be used in embodiments of the light system. The illustrated control circuitry 21 is configured to generate N control signals using (N−1) pulse width modulated (PWM) signals. In the example four control signals SC1, SC2, SC3, SC4 are generated using three PWM signals P1, P2, P3. The control module 20 comprises four AND gates 22, four delay generating circuits 23 and four OR gates 24. The three PWM signals P1, P2, P3 are presented at each of the AND gates 22 in different forms using inverters 26, 27, 28:

P1, P2, P3
not P1, P2, P3
not P1, not P2, P3
not P1, not P2, not P3

The PWM signals P1, P2, P3 are synchronized signals with respective duty cycles ¼, ½, ¾ as shown. Such a control circuitry 21 allows generating control signals SC1, SC2, SC3, SC4 which overlap partially due to the use of the delay generating circuits 23 and OR gates 24. By varying the PWM signals P1, P2, P3 (and in particular the period and/or duty cycle of the signals P1, P2, P3), different control signals may be generated in order to realize different control schemes.

Instead of the control circuitry 21 illustrated in FIG. 3, also other control circuitry may be used. For example, a so-called true complement buffer which are commercially available may fulfill the same function and may avoid glitches which are typically caused by invertors. Also, it is possible to include the control circuitry in an FPGA or an ASIC.

Figure 4:
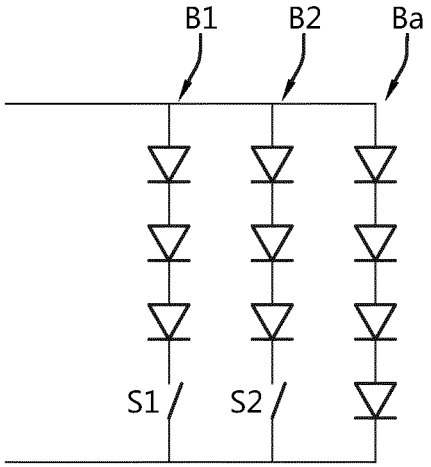
FIG. 4 is a block diagram of another exemplary embodiment of a part of a lighting system with two branches each comprising a switching element, and one additional branch without switching element.

FIG. 4 illustrate another exemplary embodiment of a light system of the invention. The light system comprises two parallel branches B1, B2 each comprising a plurality of LEDs in series with a switching element S1, S2, and one additional branch Ba without switching element. The additional branch Ba contains more LEDs connected in series that the branches B1, B2 so that Ba will be automatically off if B1 or B2 is activated, provided that the LEDs have similar forward biasing voltages.

Figure 5A:
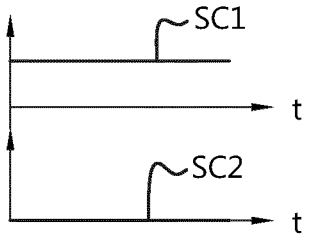
FIGS. 5A, 5B and 5C are timing diagrams illustrating exemplary control signals for controlling the lighting system of FIG. 4.
Figure 5B:
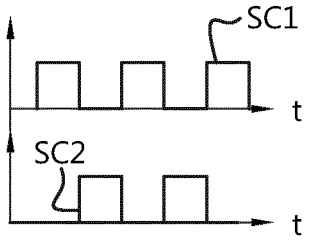
Figure 5C:
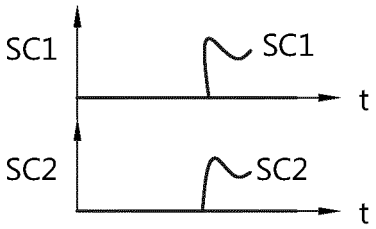
Figure 6:
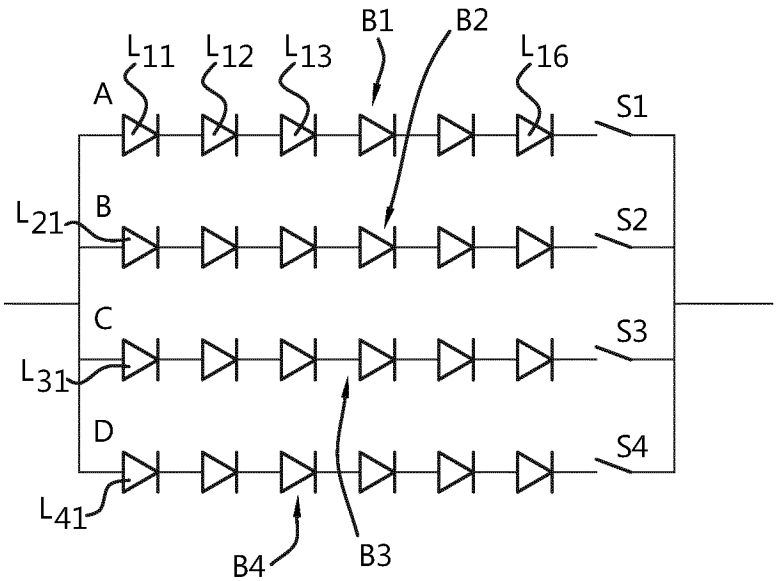
FIG. 6 illustrates schematically an exemplary embodiment of a switching element.
Figure 6:
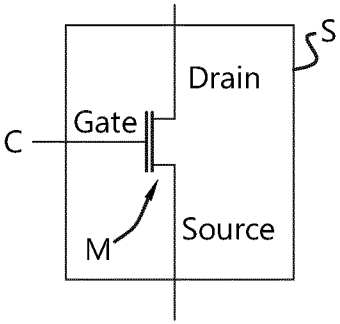

FIGS. 5A-5C illustrate that the switching elements S1 and S2 of the branches B1, B2 may be controlled according to three different control schemes comprising:

FIG. 5A: a first control scheme wherein control signal SC1 activates the first branch B1 and control signal SC2 switches off the second branch B2; the additional branch Ba will then also be off;

FIG. 5B: a second control scheme wherein control signals SC1 and SC2 alternatively activate the first branch B1 and the second branch B2; the additional branch Ba will then also be off;

FIG. 5C: a third control scheme wherein control signal SC1 switches off the first branch B1 and control signal SC2 switches off the second branch B2; the additional branch Ba will then be automatically switched on;

FIG. 6 illustrates schematically an exemplary embodiment of a switching element S. The switching element may be a MOSFET M with a gate which is connected to a control output line C and with a source and a drain as indicated. In a first embodiment the voltage levels on the control output line may be such that the MOSFET is operated in its saturation regime. In another embodiment, the voltage levels on the control output line may be such that the MOSFET is operated in its linear zone so that the switching element S functions as a valve. This will provide an additional means for controlling the current during the switching of the switching elements.

Figure 7:
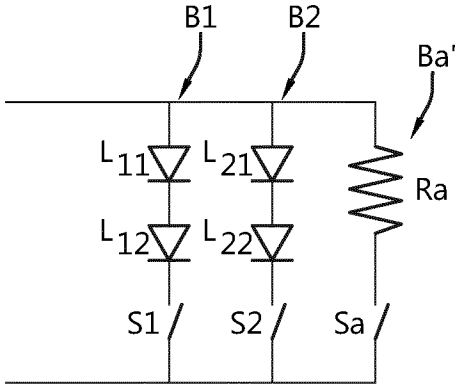
FIG. 7 illustrates schematically another exemplary embodiment of a part of a lighting system with two branches each comprising one or more lighting elements and an additional branch without a lighting element.

FIG. 7 illustrates schematically another exemplary embodiment of a part of a lighting system with two branches B1, B2 each comprising one or more lighting elements L11, L12; L21, L22 connected in series with a switching element S1, S2 and an additional branch Ba' without a lighting element but with a resistor Ra connected in series with a switching element Sa. Such an additional branch Ba may be useful if B1 and B2 need to be deactivated for certain periods of time. During those periods of time the switching element Sa may be closed. Also, during or shortly before the switching of S1 and/or S2, branch Ba may be activated to further control the switching. Further, such configuration offers the possibility to facilitate the switching of the branches by starting with a closed switch Sa by default.

Figure 9:
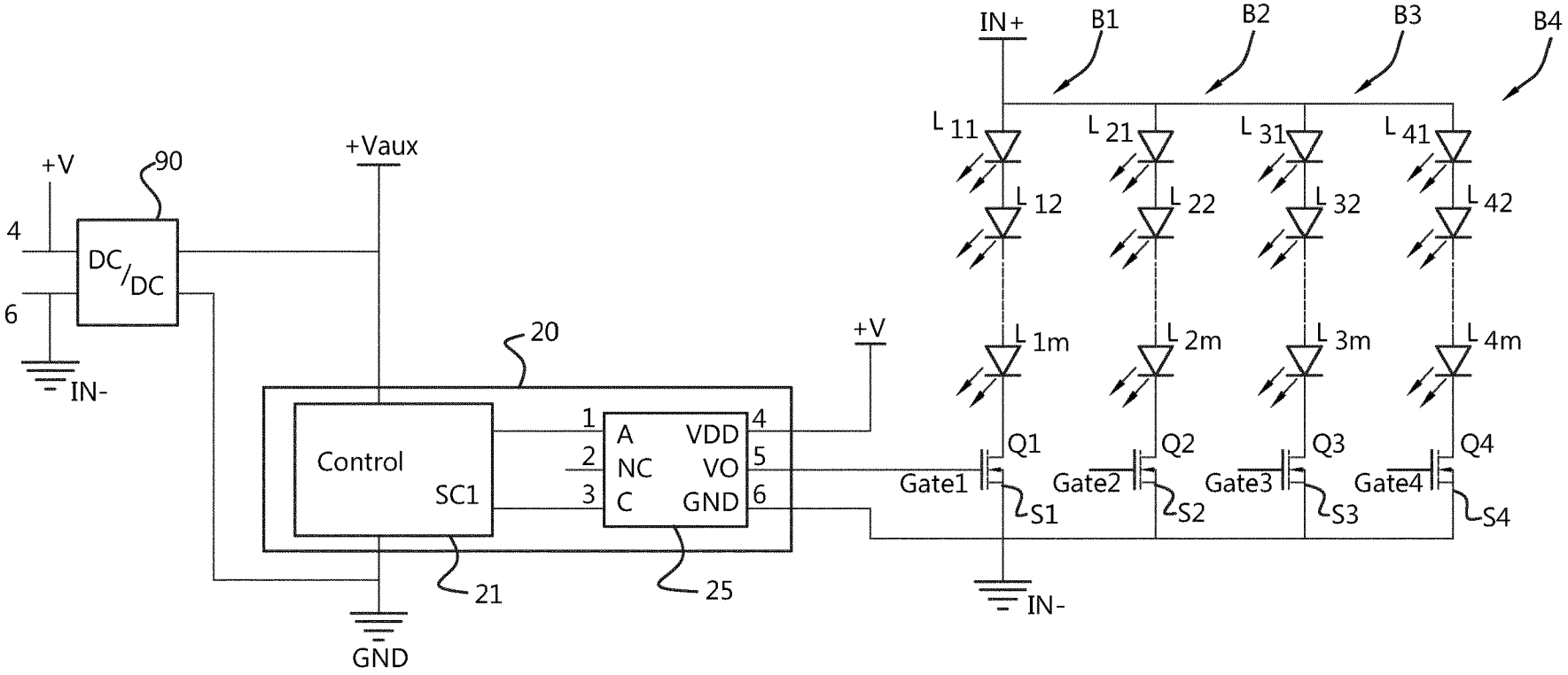
FIG. 9 is a block diagram of an exemplary embodiment of a lighting system.

FIG. 9 shows yet another embodiment which is similar to the embodiment of FIG. 1, wherein the switching elements S1-S4 are implemented as MOSFETs Q1-Q4, and wherein the number of branches is four and the number of lighting elements in each branch is m. A control signal SC1 generated by the control circuitry 21 is provided at the gate of the first MOSFET Q1 through a galvanic isolation circuit 25, e.g. an opto-coupler. As illustrated, the supply voltage (+V, IN−) at the terminals 4, 6 for powering the galvanic isolation circuit 25 may also be provided based on the auxiliary voltage Vaux, using a DC/DC converter 90. In a similar manner, control signals SC2, SC3, SC4 generated by the control circuitry 21 are provided at the gate of the second, third and fourth MOSFETs Q2, Q3, Q4, respectively, through respective galvanic isolation circuits (not shown).

The invention further relates to a luminaire system comprising a light system according to any one of the embodiments described above. The luminaire system comprises a luminaire head, and optionally a luminaire pole. The luminaire head may be connected in any manner known to the skilled person to the luminaire pole. In other embodiments, the luminaire head may be connected to a wall or a surface, e.g. for illuminating buildings or tunnels. The luminaire head comprises a luminaire housing in which a support, typically a PCB, with the lighting elements is arranged. The driver 10 may be arranged in or on a luminaire head, in or on the luminaire pole, or in any other suitable location of the luminaire system.

Figure 10:
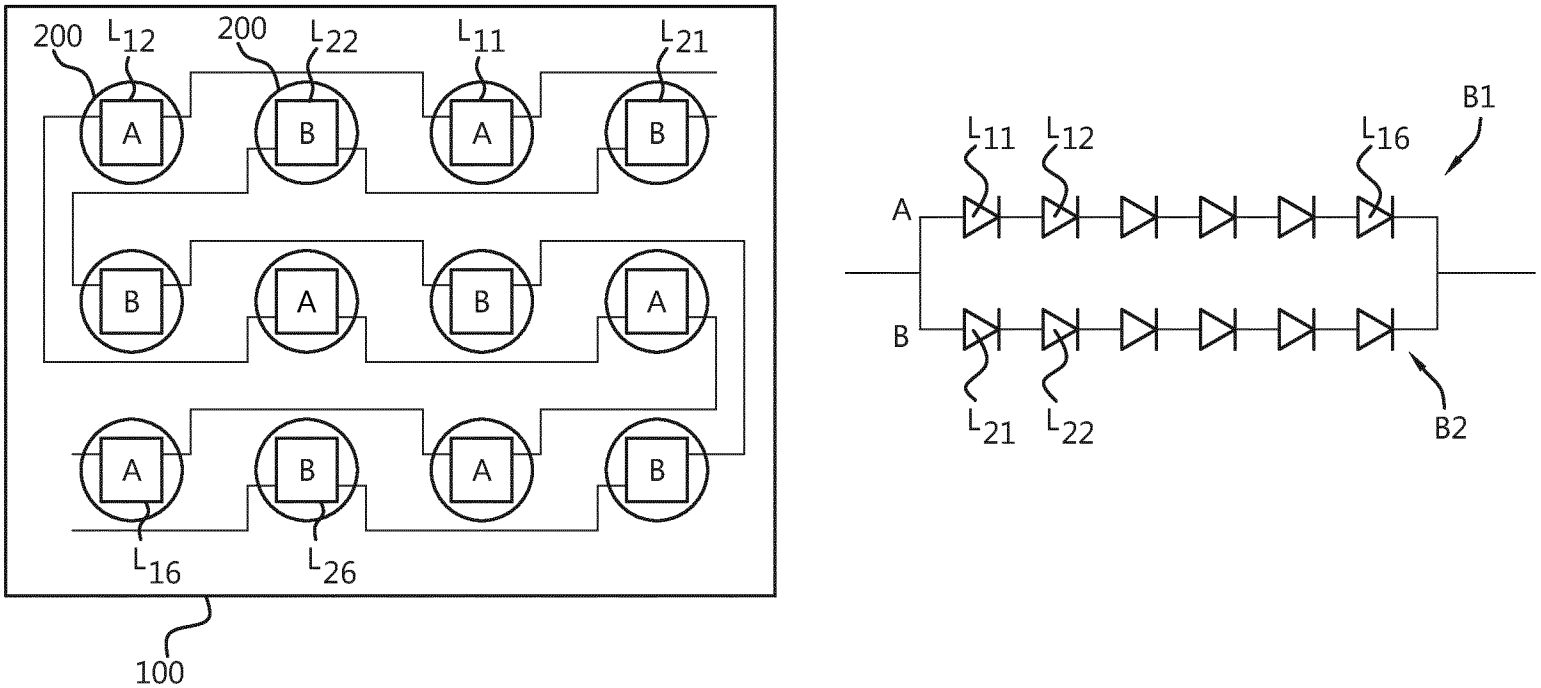
FIG. 10 illustrates schematically an exemplary embodiment of a part of a lighting system with two branches.

FIG. 10 illustrates another example where the light elements of the branches B1, B2 are arranged in an array on a PCB 100. The array comprises at least two rows and at least two columns. In the illustrated example the light system comprises two branches B1, B2 with each six light elements and respective switching elements S1, S2, but the skilled person understands that the number of light elements in a branch will be higher as the number of light elements in the array increases. A plurality of optical elements 200, e.g. lens elements, is arranged above the lighting elements. The optical elements 200 may be integrated within a single plate positioned parallel to the PCB 100. In the illustrated example, each light element is associated with an optical element 200, but it will be understood that it is also possible to associate two or more light elements with a single optical element. The light elements L11 . . . L16 of the first branch B1 are of a first type A. The light elements L21 . . . L26 of the second branch B2 are of a second type B which may be the same or different as the first type A. The light elements may be arranged in an array on a PCB 100 according to a checkerboard pattern, but also other patterns are possible, e.g. AABBAABB, etc. In the example of FIG. 10, the light elements of the same branch are not adjacent to one another in the array on the PCB 100. Optionally, light elements may be positioned differently underneath an optical element, e.g. decentral in a first direction for light elements of type A and decentral in a second different direction for light elements of type B. The types A, B may be the same or may correspond e.g. with different colors or with different kinds of white. For example A, B may correspond with warm white and cold white, respectively.

According to a possible embodiment, the plurality of light elements of the first branch B1 is configured to emit substantially the same color as the plurality of light elements of a second branch B2. For example, the first and second branch B1, B2 may contain identical light elements. By having a first and a second different control scheme, as defined above it will be possible to change the resulting light distribution. By light distribution, it is meant the distribution generated by the light emitted by the light elements, through the optical elements 200. The light distribution is delimited by a conical envelope, typically a non-circular conical shape, containing the light leaving the one or more optical elements. The light distribution represents the emission directions and the intensity variations of the light within the envelope. Thus, the conical envelope and the light pattern on the ground may be different according to a first or second control scheme. The resulting light distribution according to the first and second control scheme may have a different color and/or a different light distribution. For example, according to the first control scheme the light distribution may have a first conical envelope and the light may be of a first color, and according to the second control scheme the light distribution may have a second conical envelope and a second color, wherein the first conical envelope is different from the second conical envelope and/or wherein the first color is different from the second color.

According to a possible embodiment, a row of the array comprises light elements of two different branches B1, B2.

According to an exemplary embodiment the light elements of the branches B1, B2 are associated with a set containing at least two different optical elements. In other words, different optical elements 200 may be used above different light elements or groups of light elements. The different optical elements may be used for light elements of the same branch or for light elements of a different branch. In an exemplary embodiment, the light elements of the first branch B are associated with first optical elements 200 and the light elements of the second branch B2 are associated with second optical elements 200 which are different from the first optical elements. In that manner the conical envelope of the light distribution obtained with a first control scheme will be different from the conical envelope of the light distribution obtained with a second control scheme. It is noted that each light element of the first branch B1 may be associated with an optical element of a first type and each light element of the second branch B2 may be associated with an optical element of a second type different from the first type, as illustrated in FIG. 10, but also other combinations are possible. For example, multiple light elements of the first branch B1 may be put under a single optical element of the first type which is different from the one or more optical elements associated with the second branch B2. Also, multiple different optical elements may be associated with a single branch. The optical elements 200 may be any one of the optical elements as defined in the summary.

Figure 11:
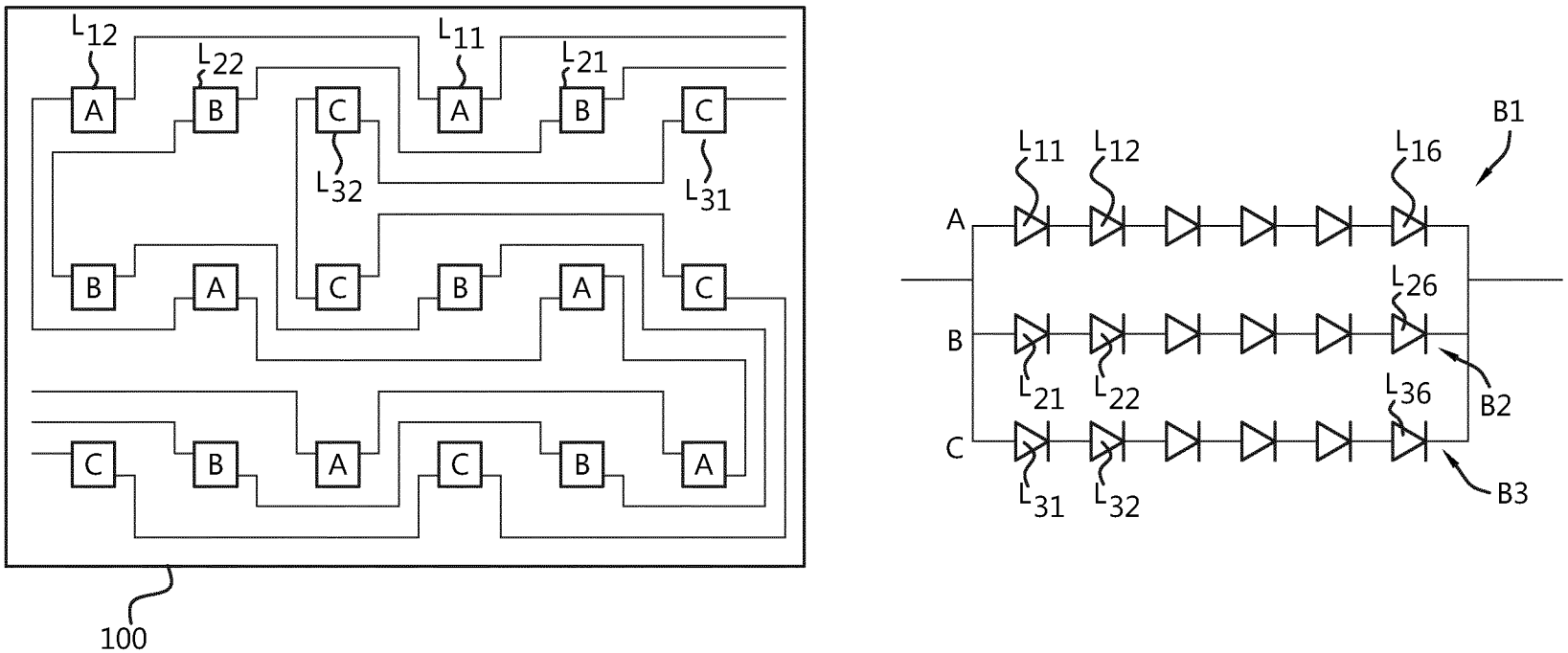
FIG. 11 illustrates schematically an exemplary embodiment of a part of a lighting system with three branches.

FIG. 11 illustrates another example where the light elements of the branches B1, B2, B3 are arranged in an array on a PCB 100. The array comprises at least two rows and at least two columns. In the illustrated example the light system comprises three branches B1, B2, B3 with each six light elements and respective switching elements S1, S2, S3, but the skilled person understands that the number of light elements in a branch will be higher as the number of light elements in the array increases. A plurality of optical elements (not shown), e.g. lens elements, may be arranged above the lighting elements. The optical elements may be integrated within a single plate positioned parallel to the PCB 100. In a possible example, each light element is associated with an optical element as in FIG. 10, but it will be understood that it is also possible to associate two or more light elements with a single optical element, e.g. as in FIG. 8. The light elements L11 . . . L16 of the first branch B1 are of a first type A. The light elements L21 . . . L26 of the second branch B2 are of a second type B which may be the same or different as the first type A. The light elements L21 . . . L26 of the third branch B3 are of a third type C which may be the same or different as the first type A. It is noted that it is also possible to include different light elements in the same branch. The light elements may be arranged in an array on a PCB 100 according to a predetermined pattern, e.g. such that a row of the array comprises light elements of three different branches B1, B2, B3. Optionally, light elements may be positioned differently underneath an optical element, e.g. decentral in a first direction for light elements of type A and decentral in a second different direction for light elements of type B. The types A, B, C may be the same or may correspond e.g. with different colors or with different kinds of white. For example A and B may correspond with warm white and C may correspond with cold white.

According to a possible embodiment, the plurality of light elements of the first branch B1 is configured to emit substantially the same color as the plurality of light elements of a second and third branch B2, B3. For example, the first, second and third branch B1, B2, B3 may contain identical light elements. By having multiple different control schemes, as defined above it will be possible to change the resulting light distribution as defined above. Thus, the conical envelope and the light pattern on the ground may be different according to various different control scheme. For example, the resulting light distribution according to a first and second control scheme may have a different color and/or a different light distribution. For example, according to the first control scheme the light distribution may have a first conical envelope and the light may be of a first color, and according to the second control scheme the light distribution may have a second conical envelope and a second color, wherein the first conical envelope is different from the second conical envelope and/or wherein the first color is different from the second color.

According to an exemplary embodiment the light elements of the branches B1, B2, B3 are associated with a set containing at least three different optical elements. In other words, different optical elements 200 may be used above different light elements or groups of light elements. The different optical elements may be used for light elements of the same branch or for light elements of a different branch. In an exemplary embodiment, the light elements of the first branch B1 are associated with first optical elements 200, the light elements of the second branch B2 are associated with second optical elements 200, and the light elements of the third branch B3 are associated with one or more third optical elements, wherein the first, second and third optical elements may be different. In that manner the conical envelope of the light distribution obtained with a first control scheme will be different from the conical envelope of the light distribution obtained with a second control scheme. The optical elements 200 may be any one of the optical elements as defined in the summary.

Whilst the principles of the invention have been set out above in connection with specific embodiments, it is to be understood that this description is merely made by way of example and not as a limitation of the scope of protection which is determined by the appended claims.

The invention claimed is:

1. A light system comprising:

at least two parallel branches, each branch comprising a series connection of a plurality of light elements and a switching element, said at least two parallel branches being intended to share a common regulated current source configured for feeding the at least two parallel branches; and a control module having a supply input line and at least two control output lines, said at least two control output lines being connected for controlling the switching elements of the at least two parallel branches, said control module comprising a galvanic isolation between the supply input line and the at least two control output lines, wherein the control module is configured for controlling the switching elements of the at least two parallel branches according to at least two different control schemes comprising:

a first control scheme, which is such that the plurality of light elements of a first branch of said at least two branches is on during a first percentage of an operational time during which the light system operates according to the first control scheme, wherein the first percentage may be any value between 0 and 100%; and a second control scheme, which is such that the plurality of light elements of the first branch of said at least two branches is on during a second percentage of an operational time during which the light system operates according to the second control scheme, wherein the first percentage is different from the second percentage.

2. The light system according to claim 1, wherein the plurality of light elements of a first branch of the at least two branches is configured to emit substantially the same color as the plurality of light elements of a second branch of the at least two branches.

3. The light system according to claim 1, wherein the light elements of the at least two branches are arranged in an array comprising at least two rows, and wherein a row of said at least two rows comprises light elements of two different branches of said at least two parallel branches.

4. The light system according to claim 1, wherein each light element of the at least two branches is associated with a distinct optical element, preferably a lens element.

5. The light system according to claim 1, wherein the light elements of the at least two branches are associated with a set containing at least two different optical elements.

6. The light system according to claim 1, wherein the light elements of a first branch of the at least two branches is associated with at least one first optical element, and wherein a second branch of the at least two branches is associated with at least one second optical element which is different from the at least one first optical element.

7. The light system according to claim 1, wherein the first control scheme defines a first light distribution having a first conical envelope, and wherein the second control scheme defines a second light distribution having a second conical envelope, said second conical envelope being different from said first conical envelope.

8. The light system according to claim 1, wherein:

the first control scheme is such that the first branch of said at least two branches is never activated, whilst at least one other branch of the at least two branches is activated for at least a portion of an operational time during which the light system operates according to the first control scheme; and the second control scheme is such that the at least two branches are alternatively activated with a limited amount of overlap.

9. The light system according to claim 1, wherein each branch of the at least two branches comprises the same number of lighting elements, and wherein optionally each lighting element of each branch has substantially the same forward biasing voltage.

10. The light system according to claim 1, wherein the control module is configured to receive a desired light output as an input, to select a control scheme out of a plurality of different stored control schemes in accordance with the desired light output, and to control the switching elements in accordance with the selected control scheme, wherein optionally the at least two branches comprises at least a first, a second and a third branch, wherein the control module is configured for controlling the switching elements of the first, second and third branch according to a plurality of control schemes, and wherein the plurality of control schemes comprises at least a first control scheme for which the first branch is never activated, a second control scheme for which the second branch is never activated, and a third control scheme for which the third branch is never activated.

11. The light system according to claim 1, wherein a first branch of the at least two branches comprises a first set of light elements and a second branch of the at least two branches comprises a second set of light elements, said second set being different from the first set, wherein optionally the first set is configured to generate light of a first color and the second set is configured to generate light of a second different color.

12. The light system according to claim 1, wherein the light elements of the at least two branches are arranged in an array comprising at least two rows and at least two columns, wherein optionally each branch comprises at least two light elements, and wherein at least two adjacent light elements of said array correspond with light elements of the same branch, wherein preferably each light element comprises one or more light emitting diodes.

13. A luminaire system comprising a light system according to claim 1, comprising optionally a luminaire head with a housing, wherein the at least two parallel branches with lighting elements are arranged on a PCB in the housing.

14. A light system comprising:

at least two parallel branches, each branch comprising a series connection of at least one light element and a switching element, said at least two parallel branches being intended to share a common regulated current source configured for feeding the at least two parallel branches; and a control module having a supply input line and at least two control output lines, said at least two control output lines being connected for controlling the switching elements of the at least two parallel branches, said control module comprising a galvanic isolation between the supply input line and the at least two control output lines, wherein the control module is configured to generate at least two control signals on said at least two control output lines such that during a first time interval only a first switching element of said at least two switching elements is on and the other one or more switching elements of said at least two switching elements is/are off, during a subsequent overlap interval said first switching element and one other switching element of said at least two switching elements are on, and during a subsequent second time interval said first switching element is off and only said one other switching element of said at least two switching elements is on.

15. The light system according to claim 14, wherein the overlap interval is between 1 and 500 ns, preferably between 5 and 100 ns.

16. The light system according to claim 14, wherein the at least two control signals are periodic signals, and wherein optionally each control signal of said at least two control signals has a period between 1 microsecond and 1 millisecond, preferably between 1 and 500 microseconds.

17. The light system according to claim 14, wherein the control module is configured to adjust the duration of the overlap interval.

18. The light system according to claim 14, wherein the control module is configured for controlling the switching elements of the at least two parallel branches according to at least two different control schemes comprising:

a first control scheme, wherein the at least two control signals are such that the at least one light element of a first branch of said at least two branches is on during a first percentage of an operational time during which the light system operates according to the first control scheme, and wherein the first percentage may be any value from 0% to 100%; and a second control scheme, wherein the at least two control signals are such that the at least one light element of the first branch of said at least two branches is on during a second percentage of an operational time during which the light system operates according to the second control scheme, and wherein the first percentage is different from the second percentage.

19. The light system according to claim 14, wherein the at least two branches comprise at least a first and a second branch, and wherein the control module is configured for controlling the switching elements of the at least two parallel branches according to at least two different control schemes comprising:

a first control scheme for which the first branch is never activated; and a second control scheme for which the first and second branch are activated using the at least two control signals such that during the first time interval only the first switching element of the first branch is on and the other one or more switching elements of the at least two branches are off, during the subsequent overlap interval the first and second switching element of the first and second branch are on, and during the subsequent second time interval said first switching element is off and only said second switching element is on.

20. A light system comprising:

at least two parallel branches, each branch comprising a series connection of a plurality of light elements and a switching element; and a control module having at least two control output lines, said at least two control output lines being connected for controlling the switching elements of the at least two parallel branches, wherein the control module is configured for controlling the switching elements of the at least two parallel branches according to at least two different control schemes comprising:

a first control scheme which is such that the plurality of light elements of a first branch of said at least two branches is on during a first percentage of an operational time during which the light system operates according to the first control scheme, wherein the first percentage may be any value between 0 and 100%; and a second control scheme which is such that the plurality of light elements of the first branch of said at least two branches is on during a second percentage of an operational time during which the light system operates according to the second control scheme, wherein the first percentage is different from the second percentage, wherein the light elements of the at least two branches are arranged in an array comprising at least two rows, and wherein a row of said at least two rows comprises light elements of two different branches of said at least two parallel branches.

21. A light system comprising:

at least two parallel branches, each branch comprising a series connection of a plurality of light elements and a switching element, said at least two parallel branches being intended to share a common regulated current source configured for feeding the at least two parallel branches; and a control module having a supply input line and at least two control output lines, said at least two control output lines being connected for controlling the switching elements of the at least two parallel branches, wherein the control module is configured for controlling the switching elements of the at least two parallel branches according to at least two different control schemes comprising:

a first control scheme, which is such that the plurality of light elements of a first branch of said at least two branches is on during a first percentage of an operational time during which the light system operates according to the first control scheme, wherein the first percentage may be any value between 0 and 100%; and a second control scheme, which is such that the plurality of light elements of the first branch of said at least two branches is on during a second percentage of an operational time during which the light system operates according to the second control scheme, wherein the first percentage is different from the second percentage, wherein the first control scheme defines a first light distribution having a first conical envelope and wherein the second control scheme defines a second light distribution having a second conical envelope, said second conical envelope being different from said first conical envelope.

* * * * *